US008481474B1

(12) United States Patent
Blattner et al.

(10) Patent No.: US 8,481,474 B1
(45) Date of Patent: Jul. 9, 2013

(54) QUATERNIZED ALKYL IMIDAZOLINE IONIC LIQUIDS USED FOR ENHANCED FOOD SOIL REMOVAL

(75) Inventors: Amanda R. Blattner, Prior Lake, MN (US); Charles A. Hodge, Cottage Grove, MN (US)

(73) Assignee: Ecolab USA Inc., Saint Paul, MN (US)

( * ) Notice: Subject to any disclaimer, the term of this patent is extended or adjusted under 35 U.S.C. 154(b) by 0 days.

(21) Appl. No.: 13/471,532

(22) Filed: May 15, 2012

(51) Int. Cl.
*C11D 1/58* (2006.01)

(52) U.S. Cl.
USPC ..... 510/237; 510/235; 510/253; 510/480; 510/499; 510/500; 510/504

(58) Field of Classification Search
USPC ..... 510/235, 237, 253, 480, 499, 500, 510/504
See application file for complete search history.

(56) References Cited

U.S. PATENT DOCUMENTS

| | | | | |
|---|---|---|---|---|
| 4,165,293 | A | 8/1979 | Gordon | |
| 4,259,217 | A | 3/1981 | Murphy | |
| 4,339,335 | A | 7/1982 | Wixon | |
| 4,793,943 | A | 12/1988 | Haslop et al. | |
| 4,830,782 | A | 5/1989 | Broze et al. | |
| 4,871,467 | A | 10/1989 | Akred et al. | |
| 6,007,585 | A * | 12/1999 | Syed et al. | 8/432 |
| 6,039,936 | A | 3/2000 | Restle et al. | |
| 6,491,840 | B1 | 12/2002 | Frankenbach et al. | |
| 6,531,270 | B1 | 3/2003 | Olson et al. | |
| 6,531,273 | B1 | 3/2003 | Olson et al. | |
| 6,586,166 | B1 | 7/2003 | Olson et al. | |
| 6,605,581 | B1 | 8/2003 | Cao et al. | |
| 6,605,584 | B2 | 8/2003 | Fong et al. | |
| 7,541,320 | B2 | 6/2009 | Dabkowski et al. | |
| 7,718,596 | B2 | 5/2010 | Briggs et al. | |
| 7,776,810 | B2 | 8/2010 | Jordan, IV et al. | |
| 7,786,064 | B1 | 8/2010 | Hecht et al. | |
| 7,786,065 | B2 | 8/2010 | Hecht et al. | |
| 7,858,575 | B2 | 12/2010 | De Block | |
| 7,928,053 | B2 | 4/2011 | Hecht et al. | |
| 7,939,485 | B2 | 5/2011 | Price et al. | |
| 8,071,520 | B2 | 12/2011 | Hodge et al. | |
| 2004/0002438 | A1 | 1/2004 | Hawkins et al. | |
| 2004/0077519 | A1 | 4/2004 | Price et al. | |
| 2004/0154489 | A1 * | 8/2004 | Deutsch et al. | 101/463.1 |
| 2005/0143517 | A1 | 6/2005 | Schmidt | |
| 2005/0158270 | A1 * | 7/2005 | Frantz et al. | 424/70.24 |
| 2006/0090271 | A1 | 5/2006 | Price et al. | |
| 2006/0166856 | A1 | 7/2006 | Petrat et al. | |
| 2008/0070966 | A1 | 3/2008 | Elder et al. | |
| 2009/0029887 | A1 | 1/2009 | Schwab et al. | |
| 2009/0036334 | A1 | 2/2009 | Schwab et al. | |
| 2009/0242854 | A1 * | 10/2009 | Li et al. | 252/519.33 |
| 2009/0291872 | A1 | 11/2009 | Bara et al. | |
| 2010/0016205 | A1 | 1/2010 | Schwab | |
| 2010/0029519 | A1 | 2/2010 | Schwab et al. | |
| 2010/0115706 | A1 | 5/2010 | Bender | |
| 2010/0297532 | A1 | 11/2010 | Beste et al. | |
| 2011/0021405 | A1 | 1/2011 | Somerville Roberts et al. | |
| 2011/0187010 | A1 * | 8/2011 | Small | 257/798 |
| 2012/0046216 | A1 | 2/2012 | Hodge et al. | |
| 2012/0048295 | A1 * | 3/2012 | Du et al. | 134/3 |

FOREIGN PATENT DOCUMENTS

| | | | |
|---|---|---|---|
| DE | 1 801 141 | | 4/1970 |
| EP | 1 790 328 | A1 | 5/2007 |
| EP | 1 920 824 | A1 | 5/2008 |
| GB | 1 336 556 | | 11/1973 |
| GB | 2 133 813 | A | 8/1984 |
| GB | 2 318 362 | A | 4/1998 |
| WO | WO 02/102948 | A2 | 12/2002 |
| WO | WO 2006/027069 | A1 | 3/2006 |
| WO | WO 2006/027070 | A1 | 3/2006 |
| WO | WO 2006/111712 | A2 | 10/2006 |
| WO | WO 2007/059822 | A1 | 5/2007 |
| WO | WO 2010/040917 | A1 | 4/2010 |

OTHER PUBLICATIONS

Colonial Chemical, Inc., "Poly SugaBetaine L" http://www.colonialchem.com/Products/Personal-Care/Poly-SugaBetaine/28/Poly-SugaBet . . . [retrieved from Internet on Feb. 22, 2012], 1 page.
Colonial Chemical, Inc., "ColaSolv IES & OES", http://www.colonialchem.com/Products/Household-and-Industrial/ColaSolv/149/ColaSolv . . . [retrieved from Internet on Feb. 22, 2012], 3 pages.
Galante, D. C. et al., "Heavy-Duty Laundry Detergents", JACOS, Apr. 1981, pp. 356A-362A.
Puchta, Rolf, "Cationic Surfactants in Laundry Detergents and Laundry Aftertreatment Aids", JAOCS, vol. 61, No. 2, Feb. 1984.
Wu, Jiapei et al., "Aggregation Behavior of Polyoxyethylene (20) Sorbitan Monolaurate (Tween 20) in Imidazolium Based Ionic Liquids", Langmuir 2008, 24, pp. 9314-9322.

* cited by examiner

*Primary Examiner* — Charles Boyer
(74) *Attorney, Agent, or Firm* — McKee, Voorhees & Sease, P.L.C.

(57) ABSTRACT

A cleaning composition including an ionic liquid, and preferably no co-surfactants are provided. The compositions are substantially free of alkyl phenol ethoxylates, including nonyl phenol ethoxylates. The cleaning compositions provide superior cleaning efficacy for various soils, including proteins and food soils, providing an effective, biorenewable, environmentally friendly alternative to nonyl phenol ethoxylates.

16 Claims, 8 Drawing Sheets

QUATERNIZED ALKYL IMIDAZOLINE IONIC LIQUIDS USED FOR ENHANCED FOOD SOIL REMOVAL

FIELD OF THE INVENTION

The present invention relates to the field of hard surface cleaning compositions. In particular, the invention relates to a hard surface cleaning composition including an ionic liquid.

BACKGROUND OF THE INVENTION

Conventional detergents used in the warewashing and laundering industries, particularly those intended for institutional use, generally contain alkyl phenol ethoxylates (APEs). APEs are used in detergents as a cleanser and a degreaser for their effectiveness at removing soils containing grease from a variety of surfaces. Commonly used APEs include nonyl phenol ethoxylates (NPE) surfactants.

However, while effective, APEs are disfavored due to environmental concerns. For example, NPEs are formed through the combination of ethylene oxide with nonylphenol (NP). Both NP and NPEs exhibit estrogen-like properties and may contaminate water, vegetation and marine life. NPE is also not readily biodegradable and remains in the environment or food chain for indefinite time periods. There is therefore a need in the art for an environmentally friendly and biodegradable alternative that can replace APEs in hard surface cleaners.

In general, ionic liquids refer to a class of materials including molten salts which remain liquid at temperatures of 100° C. or below. The ionic liquids are described as having to discernible melting point (based on DSC analysis) and are "flowable" at temperatures of about 100° C. or below. Ionic liquids have very low vapor pressure and generate virtually no hazardous vapors. As a result of the charged species comprising the ionic fluids, they provide a highly polar medium. Ionic liquids are generally appreciated to be environmental-friendly or "green" alternatives to conventional organic solvents.

Accordingly, it is an objective of the claimed invention to develop cleaning compositions incorporating ionic liquids as a means for APE-replacement in cleaning compositions.

A further object of the invention is to develop cleaning compositions that perform at least as well or better than NPE products.

BRIEF SUMMARY OF THE INVENTION

In an embodiment, the present invention provides a concentrated cleaning composition comprising an ionic liquid, a water conditioning agent, an acid source, and water, wherein the cleaning composition comprises less than about 0.5% by weight alkyl phenol ethoxylates. In preferred embodiments the ionic liquid is isostearyl ethylimidazolinium ethosulfate, oleyl ethylimidazolinium ethosulfate or a combination thereof.

In a further embodiment, the present invention provides a concentrated cleaning composition comprising from about 5 wt-% to about 50 wt-% of an ionic liquid, from about 4 wt-% and about 8 wt-% of a water conditioning agent, from about 0.01 wt-% and about 1 wt-% of an acid source, and from about 30 wt-% to about 90 wt-% of water, wherein the cleaning composition is substantially free of alkyl phenol ethoxylates and employs a percentage actives of less than about 18%.

In addition aspects of the invention, a method of removing soils from a surface is provided and includes the steps of: diluting a concentrated cleaning composition with water of dilution to form a use solution, wherein the cleaning composition comprises an ionic liquid, a water conditioning agent, an acid source, and water, wherein the cleaning composition comprises less than about 0.5% by weight alkyl phenol ethoxylates; and contacting the surface with the use solution, wherein the cleaning composition employs a percentage actives of less than about 18% while providing substantially similar cleaning performance to an alkyl phenol ethoxylate-containing cleaning composition.

While multiple embodiments are disclosed, still other embodiments of the present invention will become apparent to those skilled in the art from the following detailed description, which shows and describes illustrative embodiments of the invention. Accordingly, the drawings and detailed description are to be regarded as illustrative in nature and not restrictive.

Figure 1:
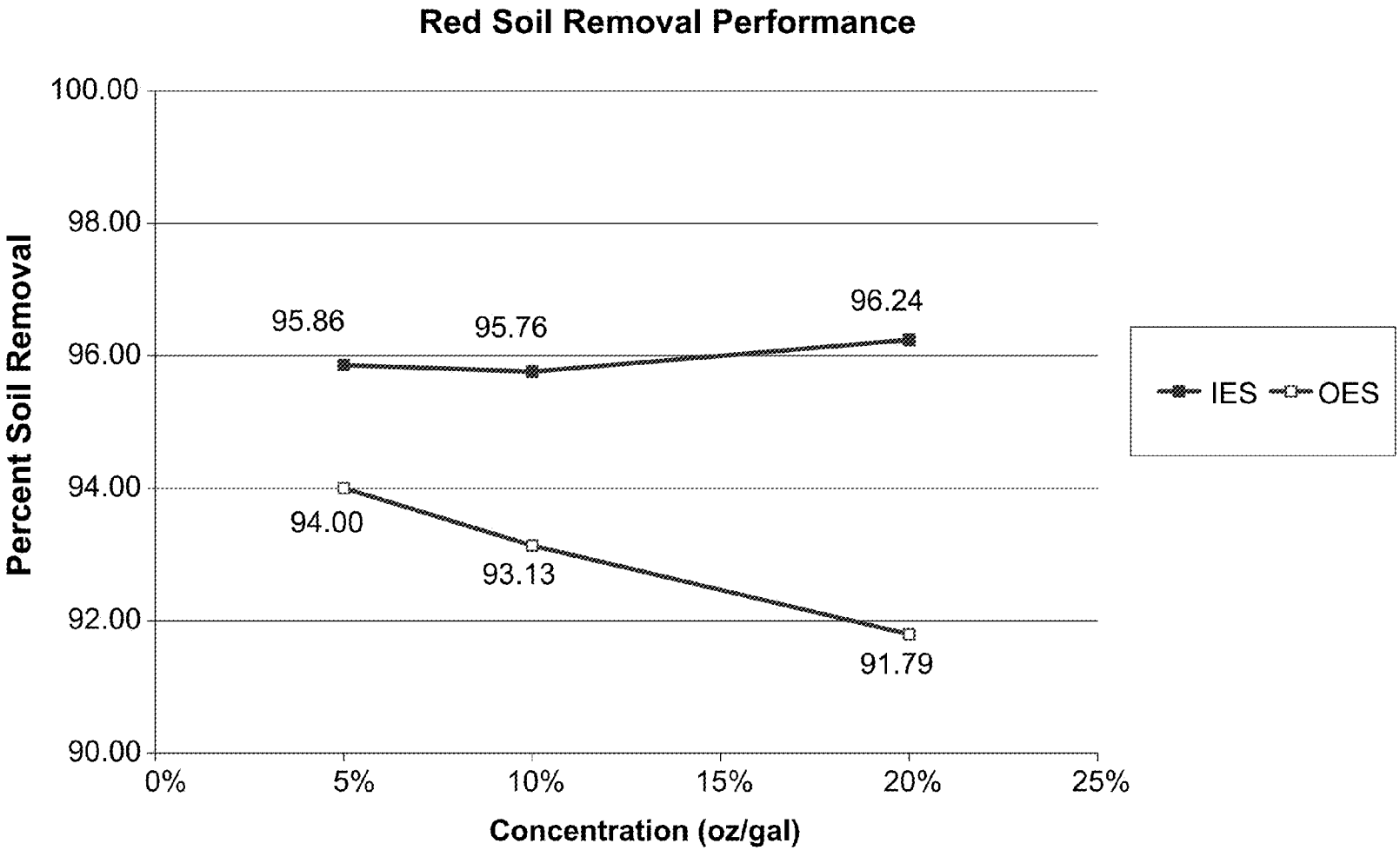
FIG. 1 is a graph showing the representative examples of Colonial Metal Degreasing Formula concentrates with 25% ionic liquids at use dilutions ranges of about 5% to about 20% on cleaning of red food soil.

Various embodiments of the present invention will be described in detail with reference to the drawings, wherein like reference numerals represent like parts throughout the several views. Reference to various embodiments does not limit the scope of the invention. Figures represented herein are not limitations to the various embodiments according to the invention and are presented for exemplary illustration of the invention.

DETAILED DESCRIPTION OF THE PREFERRED EMBODIMENTS

An advantage of the invention is the replacement of APE in cleaning compositions. In particular, ionic liquids are identified as suitable replacements for conventional, non-renewable products. It is an advantage of the present invention that more renewable cleaning compositions are provided without compromising on the efficacy of the cleaning compositions.

The compositions of the present invention provide substantially similar cleaning efficacy to NPE products, including efficacy on food soils and other soils, including difficult to remove soils such as lipstick, crayon, permanent marker, ink and pencil.

The embodiments of this invention are not limited to particular compositions and methods of employing the same, which can vary and are understood by skilled artisans. It is further to be understood that all terminology used herein is for the purpose of describing particular embodiments only, and is not intended to be limiting in any manner or scope. For example, as used in this specification and the appended claims, the singular forms "a," "an" and "the" can include plural referents unless the content clearly indicates otherwise. Further, all units, prefixes, and symbols may be denoted in its SI accepted form. Numeric ranges recited within the specification are inclusive of the numbers defining the range and include each integer within the defined range.

So that the present invention may be more readily understood, certain terms are first defined. Unless defined otherwise, all technical and scientific terms used herein have the same meaning as commonly understood by one of ordinary skill in the art to which embodiments of the invention pertain. Many methods and materials similar, modified, or equivalent to those described herein can be used in the practice of the embodiments of the present invention without undue experimentation, the preferred materials and methods are described herein. In describing and claiming the embodiments of the present invention, the following terminology will be used in accordance with the definitions set out below.

As used herein, weight percent (wt-%), percent by weight, % by weight, and the like are synonyms that refer to the concentration of a substance as the weight of that substance divided by the total weight of the composition and multiplied by 100. It is understood that, as used here, "percent," "%," and the like are intended to be synonymous with "weight percent," "wt-%," etc.

As used herein, the term "about" modifying the quantity of an ingredient in the compositions of the invention or employed in the methods of the invention refers to variation in the numerical quantity that can occur, for example, through typical measuring and liquid handling procedures used for making concentrates or use solutions in the real world; through inadvertent error in these procedures; through differences in the manufacture, source, or purity of the ingredients employed to make the compositions or carry out the methods; and the like. The term about also encompasses amounts that differ due to different equilibrium conditions for a composition resulting from a particular initial mixture. Whether or not modified by the term "about," the claims include equivalents to the quantities.

The term "actives" or "percent actives" or "percent by weight actives" or "actives concentration" are used interchangeably herein and refers to the concentration of those ingredients involved in cleaning expressed as a percentage minus inert ingredients such as water or salts.

The term "alkyl" refers to a straight or branched chain monovalent hydrocarbon radical having a specified number of carbon atoms. Alkyl groups may be unsubstituted or substituted with substituents that do not interfere with the specified function of the composition and may be substituted once or twice with the same or different group. Substituents may include alkoxy, hydroxy, mercapto, amino, alkyl substituted amino, nitro, carboxy, carbonyl, carbonyloxy, cyano, methylsulfonylamino, or halogen, for example. Examples of "alkyl" include, but are not limited to, methyl, ethyl, n-propyl, isopropyl, n-butyl, s-butyl, t-butyl, n-pentyl, n-hexyl, 3-methylpentyl, and the like.

As used herein, the terms "alkyl phenol ethoxylate-free" or "NPE-free" refers to a composition, mixture, or ingredients that do not contain alkyl phenol ethoxylates or phenol-containing compounds or to which the same has not been added. Should alkyl phenol ethoxylates or -alkyl phenol ethoxylate containing compound be present through contamination of a composition, mixture, or ingredients, the amount of the same shall be less than 0.5 wt-%. In another embodiment, the amount of is less than 0.1 wt-% and in yet another embodiment, the amount is less than 0.01 wt-%.

The term "cleaning" means to perform or aid in soil removal, bleaching, microbial population reduction, rinsing, or combination thereof.

As used herein, the term "hard surface" includes showers, sinks, toilets, bathtubs, countertops, windows, mirrors, transportation vehicles, floors, and the like. These surfaces can be those typified as "hard surfaces" (such as walls, floors, bedpans).

As used herein, a "solid" cleaning composition refers to a cleaning composition in the form of a solid such as a powder, a particle, an agglomerate, a flake, a granule, a pellet, a tablet, a lozenge, a puck, a briquette, a brick, a solid block, a unit dose, or another solid form known to those of skill in the art. The term "solid" refers to the state of the composition under the expected conditions of storage and use of the solid composition. In general, it is expected that the composition will remain in solid form when exposed to temperatures of up to about 100° F. and greater than about 120° F. A cast, pressed, or extruded "solid" may take any form including a block. When referring to a cast, pressed, or extruded solid it is meant that the hardened composition will not flow perceptibly and will substantially retain its shape under moderate stress or pressure or mere gravity, as for example, the shape of a mold when removed from the mold, the shape of an article as formed upon extrusion from an extruder, and the like. The degree of hardness of the solid cast composition can range from that of a fused solid block, which is relatively dense and hard, for example, like concrete, to a consistency characterized as being malleable and sponge-like, similar to caulking material.

As used herein, the term "substantially free" refers to compositions completely lacking the component or having such a small amount of the component that the component does not affect the effectiveness of the composition. The component may be present as an impurity or as a contaminant and shall be less than 0.5 wt-%. In another embodiment, the amount of the component is less than 0.1 wt-% and in yet another embodiment, the amount of component is less than 0.01 wt-%.

The term "substantially similar cleaning performance" refers generally to achievement by a substitute cleaning product or substitute cleaning system of generally the same degree (or at least not a significantly lesser degree) of cleanliness or with generally the same expenditure (or at least not a significantly lesser expenditure) of effort, or both, when using the substitute cleaning product or substitute cleaning system rather than a alkyl phenol ethoxylate-containing cleaning to address a typical soiling condition on a typical substrate. This degree of cleanliness may, depending on the particular cleaning product and particular substrate, correspond to a general absence of visible soils, or to some lesser degree of cleanliness.

The term "surfactant" or "surface active agent" refers to an organic chemical that when added to a liquid changes the properties of that liquid at a surface.

The term "VOC" and variations thereof, as used herein, refer to volatile organic compounds. VOCs have been found to be a major contributing factor to ozone, a common air pollutant. Ozone is not emitted into the air, but actually formed in the atmosphere through a photochemical process. VOCs in the air react with oxides of nitrogen and sunlight to form ozone. For this reason, the Environmental Protection Agency and other state regulatory agencies have determined that controlling VOCs is an effective method for minimizing ozone levels. Certain agencies may regulate the VOC levels of many consumer products with the goal of improving air quality. Consumer products are defined very broadly in these regulations and include many commercial and institutional products, including household products.

As used herein, the term "ware" includes items such as eating and cooking utensils. As used herein, the term "ware-washing" refers to washing, cleaning, or rinsing ware.

It should be noted that, as used in this specification and the appended claims, the singular forms "a," "an," and "the" include plural referents unless the content clearly dictates otherwise. Thus, for example, reference to a composition containing "a compound" includes a mixture of two or more compounds. It should also be noted that the term "or" is generally employed in its sense including "and/or" unless the content clearly dictates otherwise.

The compositions and methods of the present invention may comprise, consist essentially of, or consist of the steps, components and ingredients of the present invention as well as other ingredients described herein. As used herein, "consisting essentially of" means that the compositions and methods may include additional steps, components or ingredients, but only if the additional steps, components or ingredients do not materially alter the basic and novel characteristics of the claimed methods, systems, apparatuses, and compositions.

Ionic Liquid Cleaning Compositions

The present invention relates to hard surface cleaning compositions and methods of using the cleaning compositions for cleaning and removing organic soils from a surface. In particular, the cleaning composition is effective at removing soils including proteins, lard and oils from various surfaces. For example, the cleaning composition is effective at removing soils containing up to about 20% protein.

In one embodiment, the cleaning composition includes an ionic liquid, a water conditioning agent, and water. In another embodiment, the cleaning compositions may include a solvent. In another embodiment, the cleaning compositions may include an acid source. In a further embodiment, the cleaning compositions may include an additional functional ingredient. In another embodiment, the cleaning compositions may also include a co-surfactant. In preferred embodiments, the cleaning compositions do not require a co-surfactant for cleaning efficacy.

In concentrate form the cleaning composition may include a replacement of NPE at about 1:1 at the actives level. In additional embodiments, concentrate forms of the cleaning compositions unexpectedly require significantly less actives (ionic liquids) as a replacement for NPE. In an embodiment, the cleaning composition may include a replacement of NPE at about 0.25:1 to about 1:1 at the actives level. As shown according to embodiments of the invention various active levels of the ionic liquids may be employed to replace NPE, namely actives from about 2% to about 20%, preferably from about 4% to about 18%, most preferably from about 4.5% to about 18%.

Exemplary cleaning compositions provide from about 0.25:1 to about 1:1 replacement for NPE at the actives level and provide from about 2.25% to about 18% activity, or between about 4.5% to about 18% activity. Further exemplary cleaning compositions include between about 1 wt-% and about 50 wt-% ionic liquid component, between about 4 wt-% and about 8 wt-% water conditioning agent, between about 0.01 wt-% and about 1 wt-% acid source, preferably between about 0.1 wt-% and about 0.55 wt-% acid source, between about 0 wt-% and about 10 wt-% solvent, preferably between about 0 wt-% and about 5 wt-% solvent, and between about 30 wt-% and about 90 wt-% water. More preferred cleaning compositions include between about 1 wt-% and about 30 wt-% ionic liquid component, between about 5 wt-% and about 7 wt-% water conditioning agent, between about 0.3 wt-% and about 0.5 wt-% acid source, between about 1 wt-% and about 4% solvent and between about 40 wt-% and about 90 wt-% water. More particularly, the cleaning compositions include between about 2 wt-% and about 30 wt-% ionic liquid component, between about 5.5 wt-% and about 6.5 wt-% water conditioning agent, between about 0.35 wt-% and about 0.45 wt-% acid source, between about 2 wt-% and about 4% solvent and between about 50 wt-% and about 80 wt-% water.

In other embodiments, decreased percentage of actives may be employed as a result of the unexpected efficacy of the ionic liquid compositions providing cleaning performance at lower actives, preferably without the inclusion of any co-surfactant in the cleaning composition. In an aspect, the ionic liquid compositions are provided as a concentrate composition having less than 18% actives, from about 10% to about 18% actives, from about 7.5% to about 18% actives, from about 2% to about 10% actives (including all ranges in between). In other embodiments, similar intermediate concentrations and use concentrations may also be present in the cleaning compositions of the invention.

In one embodiment, the cleaning compositions of the present invention are substantially free of APEs, making the detergent composition more environmentally acceptable. APE-free refers to a composition, mixture, or ingredients to which APEs are not added. Should APEs be present through contamination of an APE-free composition, mixture, or ingredient, the level of APEs in the resulting composition is less than approximately 0.5 wt-%, less than approximately 0.1 wt-%, and often less than approximately 0.01 wt-%.

Ionic Liquids

In an embodiment of the invention an ionic liquid is employed in the cleaning composition to provide effective cleaning efficacy and replace traditional organic solvents and/or surfactants. Ionic liquids may include surfactants and/or solvents. Exemplary ionic liquids are bio-based, which may have bio-based content of at least 10%, preferably at least 15%, more preferably at least 50%, and still more preferably at least about 85%. As one of skill in the art shall ascertain based upon the disclosure of the present invention, the ionic liquids containing less than 100% bio-based content also include synthetic content. In some embodiments the ionic liquids are manufactured using renewable carbon and are thus an alternative to synthetic oil based surfactants. Ionic liquids act as non-flammable, low VOC solvents within cleaning compositions. The ionic liquids used according to the invention are low VOC, bio-based, non-APE/NPE surfactants providing significant cleaning efficacy. In one embodiment, the ionic liquid cleaning compositions are substantially free of alkyl phenol ethoxylates (APEs) such as nonyl phenol ethoxylates (NPEs). Thus, the ionic liquid cleaning compositions provide a green, readily biodegradable replacement for conventional detergent surfactants.

Examples of suitable ionic liquids include liquid quaternary compounds. Particularly suitable liquid quaternary compounds include quaternized alkyl imidazolines. Preferred examples include Isostearyl Ethylimidazolinium Ethosulfate, Oleyl Ethylimidazolinium Ethosulfate or combinations of the same. The ionic liquids are commercially available as Cola®Solv IES and Cola®Solv OES, respectively, which are available from Colonial Chemical, South Pittsburg, Tenn. In a preferred aspect of the invention one ionic liquid is employed for the cleaning composition.

Additional description of conventional ionic liquids is provided in, for example, U.S. Pat. Nos. 5,827,602 and 6,048,388; and PCT publications: WO 02/26701, WO 03/074494, WO 03/022812, and WO 04/016570.

Water Conditioning Agent

In an embodiment of the invention a water conditioning agent is included in the cleaning compositions. The water conditioning agent aids in removing metal compounds and in reducing harmful effects of hardness components in service water. Exemplary water conditioning agents include chelating agents, sequestering agents and inhibitors. Polyvalent metal cations or compounds such as a calcium, a magnesium, an iron, a manganese, a molybdenum, etc. cation or compound, or mixtures thereof, can be present in service water and in complex soils. Such compounds or cations can interfere with the effectiveness of a washing or rinsing compositions during a cleaning application. A water conditioning agent can effectively complex and remove such compounds or cations from soiled surfaces and can reduce or eliminate the inappropriate interaction with active ingredients including for example the ionic liquid of the invention.

Both organic and inorganic water conditioning agents are common and can be used according to the cleaning compositions of the invention. Inorganic water conditioning agents include such compounds as sodium tripolyphosphate and other higher linear and cyclic polyphosphates species. Organic water conditioning agents include both polymeric and small molecule water conditioning agents. Organic small molecule water conditioning agents are typically organocarboxylate compounds or organophosphate water conditioning agents. Polymeric inhibitors commonly comprise polyanionic compositions such as polyacrylic acid compounds. Small molecule organic water conditioning agents include, but are not limited to: sodium gluconate, sodium glucoheptonate, N-hydroxyethylenediaminetriacetic acid (HEDTA), ethylenediaminetetraacetic acid (EDTA), nitrilotriacetic acid (NTA), diethylenetriaminepentaacetic acid (DTPA), ethylenediaminetetraproprionic acid, triethylenetetraaminehexaacetic acid (TTHA), and the respective alkali metal, ammonium and substituted ammonium salts thereof, ethylenediaminetetraacetic acid tetrasodium salt (EDTA), nitrilotriacetic acid trisodium salt (NTA), ethanoldiglycine disodium salt (EDG), diethanolglycine sodium-salt (DEG), and 1,3-propylenediaminetetraacetic acid (PDTA), dicarboxymethyl glutamic acid tetrasodium salt (GLDA), methylglycine-N—N-diacetic acid trisodium salt (MGDA), and iminodisuccinate sodium salt (IDS). All of these are known and commercially available.

Acid Source

In an embodiment of the invention an acid source is included in the cleaning compositions. The acid source functions to neutralize the water conditioning agent. An example of a suitable acid source includes, but is not limited to, phosphoric acid. The acid source controls the pH of the resulting solution when water is added to the cleaning composition to form a use solution. The pH of the use solution must be maintained in the neutral to slightly alkaline range in order to provide sufficient detergency properties. This is possible because the soil removal properties of the cleaning composition are primarily due to the ionic liquids, rather than the alkalinity of the cleaning composition. In one embodiment, the pH of the use solution is between approximately 6.5 and approximately 10. In particular, the pH of the use solution is between approximately 8 and approximately 9. If the pH of the use solution is too low, for example, below approximately 6, the use solution may not provide adequate detergency properties. If the pH of the use solution is too high, for example, above approximately 11, the use solution may be too alkaline and attack or damage the surface to be cleaned.

Solvent

In an embodiment of the invention a solvent is included in the cleaning compositions. A solvent is often times useful in cleaning compositions to enhance soil removal properties. The cleaning compositions of the invention may include a solvent to adjust the viscosity of the final composition. The intended final use of the composition may determine whether or not a solvent is included in the cleaning composition. If a solvent is included in the cleaning composition, it is usually a low cost solvent such as isopropyl alcohol. A solvent may or may not be included to improve soil removal, handleability or ease of use of the compositions of the invention.

Suitable solvents useful in removing hydrophobic soils include, but are not limited to: oxygenated solvents such as lower alkanols, lower alkyl ethers, glycols, aryl glycol ethers and lower alkyl glycol ethers. Examples of other solvents include, but are not limited to: methanol, ethanol, propanol, isopropanol and butanol, isobutanol, ethylene glycol, diethylene glycol, triethylene glycol, propylene glycol, dipropylene glycol, mixed ethylene-propylene glycol ethers, ethylene glycol phenyl ether, and propylene glycol phenyl ether. Substantially water soluble glycol ether solvents include, not are not limited to: propylene glycol methyl ether, propylene glycol propyl ether, dipropylene glycol methyl ether, tripropylene glycol methyl ether, ethylene glycol butyl ether, diethylene glycol methyl ether, diethylene glycol butyl ether, ethylene glycol dimethyl ether, ethylene glycol propyl ether, diethylene glycol ethyl ether, triethylene glycol methyl ether, triethylene glycol ethyl ether, triethylene glycol butyl ether and the like.

Water

The cleaning composition also includes water. It should be appreciated that the water may be provided as deionized water or as softened water. The water provided as part of the concentrate can be relatively free of hardness. It is expected that the water can be deionized to remove a portion of the dissolved solids. That is, the concentrate can be formulated with water that includes dissolved solids, and can be formulated with water that can be characterized as hard water.

Additional Functional Materials

The cleaning compositions can include additional components or agents, such as additional functional materials (which may also be referred to as adjuvants). In some embodiments, the cleaning composition including the ionic liquid(s) may provide a large amount, or even all of the total weight of the cleaning composition, for example, in embodiments having few or no additional functional materials disposed therein. The functional materials provide desired properties and functionalities to the cleaning composition. For the purpose of this application, the term "functional materials" include a material that when dispersed or dissolved in a use and/or concentrate solution, such as an aqueous solution, provides a beneficial property in a particular use.

The cleaning preparations containing the ionic liquids may optionally contain other soil-digesting components, surfactants, disinfectants, detergent fillers, sanitizers, acidulants, complexing agents, biocides, corrosion inhibitors, antiredeposition agents, foam inhibitors, dyes, bleaching agents, enzymes, enzyme stabilizing systems, thickening or gelling agents, wetting agents, dispersants, stabilizing agents, dyes and perfumes, as described, for example, in U.S. Pat. Nos. 7,153,820 and 7,341,983, which are incorporated herein by reference in their entirety.

The various, optional additional materials can be pre-formulated with the present composition or added to the system simultaneously, or even after, the addition of the present cleaning composition. The cleaning composition can also contain any number of other constituents as necessitated by the application, which are known and which can facilitate the activity of the present compositions. Some particular examples of functional materials are discussed in more detail below, but it should be understood by those of skill in the art and others that the particular materials discussed are given by way of example only, and that a broad variety of other functional materials may be used. For example, many of the functional materials discussed below relate to materials used in cleaning and/or destaining applications, but it should be understood that other embodiments may include functional materials for use in other applications.

Surfactants

In preferred embodiments no co-surfactant is employed in the cleaning compositions according to the invention.

In an alternative aspect a co-surfactant may optionally be employed in the cleaning compositions. In the event the cleaning composition also includes a co-surfactant, the co-surfactant is employed to help increase the amount of soil removed from a surface cleaned with the composition. The co-surfactant is included in an amount such that the ratio of ionic liquid to co-surfactant is about 1:1 or greater. For example, the ratio of ionic liquid to co-surfactant can be about 1:1, about 2:1, or about 3:1. Various suitable surfactants may be employed as described herein, including those surfactants described and incorporated by reference in their entirety from, for example, U.S. Pat. No. 7,153,820.

Anionic Surfactants

The cleaning composition can contain an anionic surfactant component that includes a detersive amount of an anionic surfactant or a mixture of anionic surfactants. Anionic surfactants are desirable in cleaning compositions because of their wetting and detersive properties. The anionic surfactants that can be used according to the invention include any anionic surfactant available in the cleaning industry. Suitable groups of anionic surfactants include sulfonates and sulfates. Suitable surfactants that can be provided in the anionic surfactant component include alkyl aryl sulfonates, secondary alkane sulfonates, alkyl methyl ester sulfonates, alpha olefin sulfonates, alkyl ether sulfates, alkyl sulfates, and alcohol sulfates.

Suitable alkyl aryl sulfonates that can be used in the cleaning composition can have an alkyl group that contains 6 to 24 carbon atoms and the aryl group can be at least one of benzene, toluene, and xylene. A suitable alkyl aryl sulfonate includes linear alkyl benzene sulfonate. A suitable linear alkyl benzene sulfonate includes linear dodecyl benzyl sulfonate that can be provided as an acid that is neutralized to form the sulfonate. Additional suitable alkyl aryl sulfonates include xylene sulfonate and cumene sulfonate.

Suitable alkane sulfonates that can be used in the cleaning composition can have an alkane group having 6 to 24 carbon atoms. Suitable alkane sulfonates that can be used include secondary alkane sulfonates. A suitable secondary alkane sulfonate includes sodium $C_{14}$-$C_{17}$ secondary alkyl sulfonate commercially available as Hostapur SAS from Clariant.

Suitable alkyl methyl ester sulfonates that can be used in the cleaning composition include those having an alkyl group containing 6 to 24 carbon atoms. Suitable alpha olefin sulfonates that can be used in the cleaning composition include those having alpha olefin groups containing 6 to 24 carbon atoms.

Suitable alkyl ether sulfates that can be used in the cleaning composition include those having between about 1 and about 10 repeating alkoxy groups, between about 1 and about 5 repeating alkoxy groups. In general, the alkoxy group will contain between about 2 and about 4 carbon atoms. A suitable alkoxy group is ethoxy. A suitable alkyl ether sulfate is sodium lauryl ether sulfate and is available under the name Steol CS-460.

Suitable alkyl sulfates that can be used in the cleaning composition include those having an alkyl group containing 6 to 24 carbon atoms. Suitable alkyl sulfates include, but are not limited to, sodium lauryl sulfate and sodium lauryl/myristyl sulfate.

Suitable alcohol sulfates that can be used in the cleaning composition include those having an alcohol group containing about 6 to about 24 carbon atoms.

The anionic surfactant can be neutralized with an alkaline metal salt, an amine, or a mixture thereof. Suitable alkaline metal salts include sodium, potassium, and magnesium. Suitable amines include monoethanolamine, triethanolamine, and monoisopropanolamine. If a mixture of salts is used, a suitable mixture of alkaline metal salt can be sodium and magnesium, and the molar ratio of sodium to magnesium can be between about 3:1 and about 1:1.

The cleaning composition, when provided as a concentrate, can include the anionic surfactant component in an amount sufficient to provide a use composition having desired wetting and detersive properties after dilution with water. The concentrate can contain about 0 wt-% to about 0.5 wt-%, about 0.1 wt-% to about 1 wt-%, about 1 wt-% to about 5 wt-%, about 5 wt-% to about 10 wt-%, about 10 wt-% to about 20 wt-%, 30 wt-%, about 0.5 wt-% to about 25 wt-%, and about 1 wt-% to about 15 wt-%, and similar intermediate concentrations of the anionic surfactant.

Nonionic Surfactants

The cleaning composition can contain a nonionic surfactant component that includes a detersive amount of nonionic surfactant or a mixture of nonionic surfactants. Nonionic surfactants can be included in the cleaning composition to enhance grease removal properties. Although the surfactant component can include a nonionic surfactant component, it should be understood that the nonionic surfactant component can be excluded from the detergent composition.

Nonionic surfactants that can be used in the composition include polyalkylene oxide surfactants (also known as polyoxyalkylene surfactants or polyalkylene glycol surfactants). Suitable polyalkylene oxide surfactants include polyoxypropylene surfactants and polyoxyethylene glycol surfactants. Suitable surfactants of this type are synthetic organic polyoxypropylene (PO)-polyoxyethylene (EO) block copolymers. These surfactants include a di-block polymer comprising an EO block and a PO block, a center block of polyoxypropylene units (PO), and having blocks of polyoxyethylene grafted onto the polyoxypropylene unit or a center block of EO with attached PO blocks. Further, this surfactant can have further blocks of either polyoxyethylene or polyoxypropylene in the molecules. A suitable average molecular weight range of useful surfactants can be about 1,000 to about 40,000 and the weight percent content of ethylene oxide can be about 10-80 wt-%.

Additional nonionic surfactants include alcohol alkoxylates. An suitable alcohol alkoxylate include linear alcohol ethoxylates such as Tomadol™ 1-5 which is a surfactant containing an alkyl group having 11 carbon atoms and 5 moles of ethylene oxide. Additional alcohol alkoxylates include alkylphenol ethoxylates, branched alcohol ethoxylates, secondary alcohol ethoxylates (e.g., Tergitol 15-S-7 from Dow Chemical), castor oil ethoxylates, alkylamine ethoxylates, tallow amine ethoxylates, fatty acid ethoxylates, sorbital oleate ethoxylates, end-capped ethoxylates, or mixtures thereof. Additional nonionic surfactants include amides such as fatty alkanolamides, alkyldiethanolamides, coconut diethanolamide, lauric diethanolamide, polyethylene glycol cocoamide (e.g., PEG-6 cocoamide), oleic diethanolamide, or mixtures thereof. Additional suitable nonionic surfactants include polyalkoxylated aliphatic base, polyalkoxylated amide, glycol esters, glycerol esters, amine oxides, phosphate esters, alcohol phosphate, fatty triglycerides, fatty triglyceride esters, alkyl ether phosphate, alkyl esters, alkyl phenol ethoxylate phosphate esters, alkyl polysaccharides, block copolymers, alkyl polyglucosides, or mixtures thereof.

When nonionic surfactants are included in the detergent composition concentrate, they can be included in an amount of at least about 0.1 wt-% and can be included in an amount of up to about 15 wt-%. The concentrate can include about 0.1 to 1 wt-%, about 0.5 wt-% to about 12 wt-% or about 2 wt-% to about 10 wt-% of the nonionic surfactant.

Amphoteric Surfactants

Amphoteric surfactants can also be used to provide desired detersive properties. Suitable amphoteric surfactants that can be used include, but are not limited to: sulfosuccinates, imidazolines, and propionates. Suitable amphoteric surfactants include, but are not limited to: sultaines, amphopropionates, amphodipropionates, aminopropionates, aminodipropionates, amphoacetates, amphodiacetates, and amphohydroxypropylsulfonates.

When the detergent composition includes an amphoteric surfactant, the amphoteric surfactant can be included in an amount of about 0 wt-% to about 15 wt-%. The concentrate can include about 0.1 wt-% to about 1 wt-%, 0.5 wt-% to about 12 wt-% or about 2 wt-% to about 10 wt-% of the amphoteric surfactant.

Cationic Surfactants

The cleaning composition can contain a cationic surfactant component that includes a detersive amount of cationic surfactant or a mixture of cationic surfactants. The cationic surfactant can be used to provide sanitizing properties.

Cationic surfactants that can be used in the cleaning composition include, but are not limited to: amines such as primary, secondary and tertiary monoamines with $C_{18}$ alkyl or alkenyl chains, ethoxylated alkylamines, alkoxylates of ethylenediamine, imidazoles such as a 1-(2-hydroxyethyl)-2-imidazoline, a 2-alkyl-1-(2-hydroxyethyl)-2-imidazoline, and the like; and quaternary ammonium salts, as for example, alkylquaternary ammonium chloride surfactants such as n-alkyl($C_{12}$-$C_{18}$)dimethylbenzyl ammonium chloride, n-tetradecyldimethylbenzylammonium chloride monohydrate, and a naphthylene-substituted quaternary ammonium chloride such as dimethyl-1-naphthylmethylammonium chloride.

When the detergent composition includes an cationic surfactant, the cationic surfactant can be included in an amount of about 0 wt-% to about 15 wt-%. The concentrate can include about 0.1 wt-% to about 1 wt-%, 0.5 wt-% to about 12 wt-% or about 2 wt-% to about 10 wt-% of the cationic surfactant.

Thickening Agents

The viscosity of the cleaning composition increases with the amount of thickening agent, and viscous compositions are useful for uses where the cleaning composition clings to the surface. Suitable thickeners can include those which do not leave contaminating residue on the surface to be treated. Generally, thickeners which may be used in the present invention include natural gums such as xanthan gum, guar gum, modified guar, or other gums from plant mucilage; polysaccharide based thickeners, such as alginates, starches, and cellulosic polymers (e.g., carboxymethyl cellulose, hydroxyethyl cellulose, and the like); polyacrylates thickeners; and hydrocolloid thickeners, such as pectin. Generally, the concentration of thickener employed in the present compositions or methods will be dictated by the desired viscosity within the final composition. However, as a general guideline, the viscosity of thickener within the present composition ranges from about 0.1 wt-% to about 3 wt-%, from about 0.1 wt-% to about 2 wt-%, or about 0.1 wt-% to about 0.5 wt-%.

Bleaching Agents

The cleaning composition may also include bleaching agents for lightening or whitening a substrate. Examples of suitable bleaching agents include bleaching compounds capable of liberating an active halogen species, such as $Cl_2$, $Br_2$, —OCl— and/or —OBr—, under conditions typically encountered during the cleansing process. Suitable bleaching agents for use in the present cleaning compositions include, for example, chlorine-containing compounds such as a chlorine, a hypochlorite, and chloramine. Exemplary halogen-releasing compounds include the alkali metal dichloroisocyanurates, chlorinated trisodium phosphate, the alkali metal hypochlorites, monochloramine and dichloramine, and the like. Encapsulated chlorine sources may also be used to enhance the stability of the chlorine source in the composition (see, for example, U.S. Pat. Nos. 4,618,914 and 4,830,773, the disclosures of which are incorporated by reference in their entirety herein for all purposes). A bleaching agent may also be a peroxygen or active oxygen source such as hydrogen peroxide, perborates, sodium carbonate peroxyhydrate, phosphate peroxyhydrates, potassium permonosulfate, and sodium perborate mono and tetrahydrate, with and without activators such as tetraacetylethylene diamine, and the like. The composition can include an effective amount of a bleaching agent. When the concentrate includes a bleaching agent, it can be included in an amount of about 0.1 wt-% to about 60 wt-%, about 1 wt-% to about 20 wt-%, about 3 wt-% to about 8 wt-%, and about 3 wt-% to about 6 wt-%.

Detergent Fillers

The cleaning composition can include an effective amount of detergent fillers, which does not perform as a cleaning agent per se, but cooperates with the cleaning agent to enhance the overall cleaning capacity of the composition. Examples of detergent fillers suitable for use in the present cleaning compositions include sodium sulfate, sodium chloride, starch, sugars, $C_1$-$C_{10}$ alkylene glycols such as propylene glycol, and the like. When the concentrate includes a detergent filler, it can be included in an amount of between about 1 wt-% and about 20 wt-% and between about 3 wt-% and about 15 wt-%.

Defoaming Agents

The cleaning composition can include a defoaming agent to reduce the stability of foam and reduce foaming. When the concentrate includes a defoaming agent, the defoaming agent can be provided in an amount of between about 0.01 wt-% and about 3 wt-%.

Examples of defoaming agents that can be used in the composition includes ethylene oxide/propylene oxide block copolymers such as those available under the name Pluronic N3, silicone compounds such as silica dispersed in polydimethylsiloxane, polydimethylsiloxane, and functionalized polydimethylsiloxane such as those available under the name Abil B9952, fatty amides, hydrocarbon waxes, fatty acids, fatty esters, fatty alcohols, fatty acid soaps, ethoxylates, mineral oils, polyethylene glycol esters, alkyl phosphate esters such as monostearyl phosphate, and the like. A discussion of defoaming agents may be found, for example, in U.S. Pat. Nos. 3,048,548, 3,334,147 and 3,442,242, the disclosures of which are incorporated by reference in their entirety herein for all purposes.

Antiredeposition Agents

The cleaning composition can include an anti-redeposition agent for facilitating sustained suspension of soils in a cleaning solution and preventing the removed soils from being redeposited onto the substrate being cleaned. Examples of suitable anti-redeposition agents include fatty acid amides, fluorocarbon surfactants, complex phosphate esters, styrene maleic anhydride copolymers, and cellulosic derivatives such as hydroxyethyl cellulose, hydroxypropyl cellulose, and the like. When the concentrate includes an anti-redeposition agent, the anti-redeposition agent can be included in an amount of between about 0.5 wt-% and about 10 wt-% and between about 1 wt-% and about 5 wt-%.

Stabilizing Agents

Stabilizing agents that can be used in the cleaning composition include, but are not limited to: primary aliphatic amines, sulfosuccinates, borate, calcium ions, sodium citrate, citric acid, sodium formate, glycerine, malonic acid, organic diacids, polyols, propylene glycol, and mixtures thereof. The concentrate need not include a stabilizing agent, but when the concentrate includes a stabilizing agent, it can be included in an amount that provides the desired level of stability of the concentrate. Exemplary ranges of the stabilizing agent include up to about 20 wt-%, between about 0.5 wt-% to about 15 wt-% and between about 2 wt-% to about 10 wt-%.

Dispersants

Dispersants that can be used in the cleaning composition include maleic acid/olefin copolymers, polyacrylic acid, and its copolymers, and mixtures thereof. The concentrate need not include a dispersant, but when a dispersant is included it can be included in an amount that provides the desired dispersant properties. Exemplary ranges of the dispersant in the concentrate can be up to about 20 wt-%, between about 0.5 wt-% and about 15 wt-%, and between about 2 wt-% and about 9 wt-%.

Dyes and Fragrances

Various dyes, odorants including perfumes, and other aesthetic enhancing agents may also be included in the cleaning composition. Dyes may be included to alter the appearance of the composition, as for example, any of a variety of FD&C dyes, D&C dyes, and the like. Additional suitable dyes include Direct Blue 86 (Miles), Fastusol Blue (Mobay Chemical Corp.), Acid Orange 7 (American Cyanamid), Basic Violet 10 (Sandoz), Acid Yellow 23 (GAF), Acid Yellow 17 (Sigma Chemical), Sap Green (Keystone Aniline and Chemical), Metanil Yellow (Keystone Aniline and Chemical), Acid Blue 9 (Hilton Davis), Sandolan Blue/Acid Blue 182 (Sandoz), Hisol Fast Red (Capitol Color and Chemical), Fluorescein (Capitol Color and Chemical), Acid Green 25 (BASF), Pylakor Acid Bright Red (Pylam), and the like.

Fragrances or perfumes that may be included in the compositions include, for example, terpenoids such as citronellol, aldehydes such as amyl cinnamaldehyde, a jasmine such as C1S-jasmine or jasmal, vanillin, and the like.

Ionic Liquid Cleaning Composition Formulations

The cleaning compositions of the present invention are effective at removing soils containing proteins, lard and oils, such as food soils. In one embodiment, the cleaning composition is effective at removing soils containing up to about 20% protein. In another embodiment, the cleaning compositions are particularly effective at removing food soils. Several suitable exemplary liquid concentrate compositions are provided in Table 1 (18% actives at 1:1 replacement of NPE).

TABLE 1

| Component | Preferred Ranges (Wt-%) | | |
|---|---|---|---|
| Water | 30-90 | 40-90 | 50-80 |
| Phosphoric Acid (75%) | 0.1-0.55 | 0.3-0.5 | 0.35-0.45$_5$ |
| Isopropanol (99%) | 0-5 | 1-4 | 2-4 |
| Ionic Liquids | 1-50 | 1-30 | 2-30 |
| EDTA (40%) | 4-8 | 5-7 | 5.5-6.5 |
| Optional Co-Surfactant | 0-30 | 0-20 | 0-20 |

In an aspect of the invention, the ionic liquid cleaning compositions provide enhanced soil removal capabilities (including enhanced degreasing ability) while remaining substantially free of APE. APE's are often useful in soil removal, namely degreasing, compositions to enhance soil removal properties. Surprisingly the ionic liquid compositions of the invention do not require a co-surfactant to provide perform well as a soil remover. However, the cleaning compositions may employ a solvent to adjust the viscosity of the final composition. The intended use of the cleaning composition may determine whether or not a solvent is included in the cleaning composition.

When provided as a liquid concentrate composition, the concentrate can be diluted through dispensing equipment using aspirators, peristaltic pumps, gear pumps, mass flow meters, and the like. This liquid concentrate embodiment can also be delivered in bottles, jars, dosing bottles, bottles with dosing caps, and the like. The liquid concentrate composition can be filled into a multi-chambered cartridge insert that is then placed in a spray bottle or other delivery device filled with a pre-measured amount of water.

The concentrate composition of the present invention can be provided as a solid, liquid, or gel, or a combination thereof. In one embodiment, the cleaning compositions may be provided as a concentrate such that the cleaning composition is substantially free of any added water or the concentrate may contain a nominal amount of water. The concentrate can be formulated without any water or can be provided with a relatively small amount of water in order to reduce the expense of transporting the concentrate. For example, the composition concentrate can be provided as a capsule or pellet of compressed powder, a solid, or loose powder, either contained by a water soluble material or not. In the case of providing the capsule or pellet of the composition in a material, the capsule or pellet can be introduced into a volume of water, and if present the water soluble material can solubilize, degrade, or disperse to allow contact of the composition concentrate with the water. For the purposes of this disclosure, the terms "capsule" and "pellet" are used for exemplary purposes and are not intended to limit the delivery mode of the invention to a particular shape.

In yet another embodiment, the concentrate composition can be provided in a solid form that resists crumbling or other degradation until placed into a container. Such container may either be filled with water before placing the composition concentrate into the container, or it may be filled with water after the composition concentrate is placed into the container.

In either case, the solid concentrate composition dissolves, solubilizes, or otherwise disintegrates upon contact with water. In a particular embodiment, the solid concentrate composition dissolves rapidly thereby allowing the concentrate composition to become a use composition and further allowing the end user to apply the use composition to a surface in need of cleaning. When the cleaning composition is provided as a solid, the compositions provided herein may be altered in a manner to solidify the cleaning composition by any means known in the art. For example, the amount of water may be reduced or additional ingredients may be added to the cleaning composition, such as a solidification agent.

In another embodiment, the solid concentrate composition can be diluted through dispensing equipment whereby water is sprayed at the solid block forming the use solution. The water flow is delivered at a relatively constant rate using mechanical, electrical, or hydraulic controls and the like. The solid concentrate composition can also be diluted through dispensing equipment whereby water flows around the solid block, creating a use solution as the solid concentrate dissolves. The solid concentrate composition can also be diluted through pellet, tablet, powder and paste dispensers, and the like.

The water used to dilute the concentrate compositions of the invention (water of dilution) can be available at the locale or site of dilution. The water of dilution may contain varying levels of hardness depending upon the locale. Service waters available from various municipalities have varying levels of hardness. It is desirable to provide a concentrate that can handle the hardness levels found in the service water of various municipalities. The water of dilution that is used to dilute the concentrate can be characterized as hard water when it includes at least 1 grain hardness. It is expected that the water of dilution can include at least 5 grains hardness, at least 10 grains hardness, or at least 20 grains hardness.

It is expected that the concentrate will be diluted with the water of dilution in order to provide a use solution having a desired level of detersive properties. If the use solution is required to remove tough or heavy soils, it is expected that the concentrate can be diluted with the water of dilution at a weight ratio of at least 1:1 and up to 1:16. If a light duty cleaning use solution is desired, it is expected that the concentrate can be diluted at a weight ratio of concentrate to water of dilution of up to about 1:256.

In an alternate embodiment, the cleaning compositions may be provided as a ready-to-use (RTU) composition. If the cleaning composition is provided as a RTU composition, a more significant amount of water is added to the cleaning composition as a diluent. When the concentrate is provided as a liquid, it may be desirable to provide it in a flowable form so that it can be pumped or aspirated. It has been found that it is generally difficult to accurately pump a small amount of a liquid. It is generally more effective to pump a larger amount of a liquid. Accordingly, although it is desirable to provide the concentrate with as little water as possible in order to reduce transportation costs, it is also desirable to provide a concentrate that can be dispensed accurately. In the case of a liquid concentrate, it is expected that water will be present in an amount of up to about 90 wt-%, particularly between about 30 wt-% and about 90 wt-%, more particularly between about 40 wt-% and about 90 wt-% and most particularly between about 50 wt-% and about 80 wt-%.

In the case of a RTU composition, it should be noted that the above-disclosed cleaning composition may, if desired, be further diluted with water, including for example up to about 96 wt-% water, based on the weight of the cleaning composition.

Methods of Using the Ionic Liquid Cleaning Compositions

The methods of using the ionic liquid compositions may include the step of diluting a concentrated cleaning composition. As set forth above, the dilution step may include the use of a variety of waters for dilution. As one skilled in the art will appreciated, the amount of dilution water employed will be determined by the desired ratio of cleaning composition to water (i.e. dilution rate) to obtain a dispensing concentration suitable for a particular surface in need of cleaning. In many embodiments, the dispensing rate of the cleaning concentration will range from about 1 oz./gallon to about 64 oz./gallon, preferably from about 4 oz./gallon to about 16 oz./gallon.

According to the methods of the invention, the cleaning composition is applied to a surface in need of cleaning. Compositions of the invention may be useful to clean a variety of surfaces. Exemplary hard-surfaces suitable for cleaning with the ionic liquid compositions of the invention include ceramics, ceramic tile, grout, granite, concrete, mirrors, enameled surfaces, metals including aluminum, brass, stainless steel and the like.

The ionic liquid cleaning compositions can be used in various industries, including, but not limited to: manual and automatic warewashing, food and beverage, vehicle care, and quick service restaurants. In particular, the cleaning compositions can be used in hard-surface cleaning applications, including, for example: bathroom surfaces, dishwashing equipment, food and beverage equipment, vehicles and tabletops. As one skilled in the art shall ascertain based on the disclosure of the invention, the ionic liquid compositions are useful to formulate hard surface cleaners, oven cleaners, hand soaps, automotive detergents, warewashing detergents whether automatic or manual, and the like.

All publications and patent applications in this specification are indicative of the level of ordinary skill in the art to which this invention pertains. All publications and patent applications are herein incorporated by reference to the same extent as if each individual publication or patent application was specifically and individually indicated as incorporated by reference.

EXAMPLES

Embodiments of the present invention are further defined in the following non-limiting Examples. It should be understood that these Examples, while indicating certain embodiments of the invention, are given by way of illustration only. From the above discussion and these Examples, one skilled in the art can ascertain the essential characteristics of this invention, and without departing from the spirit and scope thereof, can make various changes and modifications of the embodiments of the invention to adapt it to various usages and conditions. Thus, various modifications of the embodiments of the invention, in addition to those shown and described herein, will be apparent to those skilled in the art from the foregoing description. Such modifications are also intended to fall within the scope of the appended claims.

The materials used for the following examples include:

Super Excellent Standard (Control): cleaner containing NPE 9.5 (18% actives), available from Ecolab Inc., Saint Paul, Minn.

Cola®Solv IES: Isostearyl Ethylimidazolinium Ethosulfate, an ionic liquid commercially-available from Colonial Chemical, South Pittsburg, Tenn.

Cola®Solv OES: Oleyl Ethylimidazolinium Ethosulfate, an ionic liquid commercially-available from Colonial Chemical, South Pittsburg, Tenn.

Cola®Teric 2COSF: Sodium Capryloamphopropionate (50% soln.) surfactant, commercially-available from Colonial Chemical, South Pittsburg, Tenn.

Cola®Cap MA 257: low foam nonionic surfactant, methyallyl capped, commercially-available from Colonial Chemical, South Pittsburg, Tenn.

Additional commercially-available materials: softened water, 75% phosphoric acid, 99% isopropanol, and 40% tetrasodium EDTA.

Table 2 shows various formulations evaluated in the following Examples.

TABLE 2

| (% Actives) | Colonial Metal Degreasing Formula* (40%) 2.5:1:1 (A:B:C) | Super Excellent Standard (18%) | (B) (18%) | (C) (18%) | (AB) (18%) 2.5:1 (A:B) | (AC) (18%) 2.5:1 (A:C) | (BC) (18%) 1:1 (B:C) | (ABC) (18%) 2.5:1:1 (A:B:C) |
|---|---|---|---|---|---|---|---|---|
| Water (softened) | 55% | QS | QS | QS | QS | QS | QS | QS |
| Cola ® Solv IES or Cola ® Solv OES (A) | 25% | | | | 1-20% | 1-20% | | 1-20% |
| Cola ® Teric 2COSF (Sodium Capryloampho-propionate) (50%) (B) | 10% | | 20-50% | | 1-20% | | 1-20% | 1-20% |
| Cola ® Cap MA 257 (low foam nonionic, methyallyl capped) (C) | 10% | | | 1-20% | | 1-10% | 1-10% | 1-10% |
| phosphoric acid (75%) | | 0.1-0.55% | 0.1-0.55% | 0.1-0.55% | 0.1-0.55% | 0.1-0.55% | 0.1-0.55% | 0.1-0.55% |
| isopropanol (99%) | | 0-5% | 0-5% | 0-5% | 0-5% | 0-5% | 0-5% | 0-5% |
| NPE 9.5 | | 1-20% | | | | | | |
| Tetrasodium EDTA (40%) | | 4-8% | 4-8% | 4-8% | 4-8% | 4-8% | 4-8% | 4-8% |

*Colonial Metal Degreasing Formula (Formula from Cola ® Solv Technical Data Sheet)

Example 1

The efficacy of ionic liquids for food soil removal was evaluated.

Red Soil Removal Test Methods. A red soil consisting of lard, oil, protein, and iron (III) oxide (for color) was prepared. About 30 grams of lard was combined with about 30 grams of corn oil, about 15 grams of whole powdered egg, and about 1.5 grams of $Fe_2O_3$.

The back, grooved sides of a plurality of 3"×3" white vinyl tiles were soiled with approximately 0.75 grams of the red soil using a 3" foam brush. The tiles were allowed to dry at room temperature overnight. It is believed that this incubation period allowed the bonds holding the triglycerides and proteins together in the soil to begin to crystallize and interlink. The next day, the tiles were placed into a soaking tray containing about 200 grams of a test composition (as described further below in the tables) for about 1 minute.

The soil removal test was conducted using a Precision Force Applicator (PFA), available from Precision Analytical Instruments, Inc., using a synthetic sponge. The PFA is similar to the Gardner Straightline Apparatus except that it is interfaced with a computer to control various parameters, such as, for example speed, number of repetitions, time between cycles, etc. The synthetic sponge was pre-dampened with water with the excess water squeezed out and then saturated with about 50 grams of the test compositions. The tiles were then placed into the PFA with the grain of the tiles parallel to the direction of sponge travel. The tiles were scrubbed with about 2 pounds of pressure with the moistened synthetic sponge for 16 cycles, rotating the tiles 90 degrees every 4 cycles for a complete 360 degree rotation of the tiles. The tiles were then rinsed with city water and dried overnight at room temperature.

Hunter Lab L* reflectance of the soiled tiles and washed tiles were measured. The soiled tiles L* reflectance value is represented by the following equation (where 3.38, 92.1, and 24.74 are constants):

$$\text{soiled } L'^* = \frac{1}{3.38 \ln\left(\frac{92.1 - 24.74}{\text{soiled } L^* - 24.74}\right)}$$

The washed tiles L* reflectance value is represented by the following equation:

$$\text{washed } L'^* = \frac{1}{3.38 \ln\left(\frac{92.1 - 24.74}{\text{washed } L^* - 24.74}\right)}$$

The percent soil removal was then calculated as:

$$\text{percent soil removal} = \left(\frac{\text{soiled } L'^* - \text{washed } L'^*}{\text{soiled } L'^*}\right) * 100$$

The compositions according to the invention were evaluated based on two standards. First, the compositions were evaluated to determine whether an acceptable amount of red soil was removed at low concentrations (i.e., 4 oz./gallon), intermediate concentrations (i.e., 8 oz./gallon) and high concentrations (i.e., 16 oz./gallon). At 18% actives, a composition was considered to perform at an acceptable level if it removed at least about 71% red soil at low concentrations, at least about 79% red soil at intermediate concentrations and at least about 86% red soil at high concentrations.

If the composition removed an acceptable amount of red soil at all concentrations, the compositions were then evaluated to determine whether they performed substantially similarly to, and could act as a suitable replacement for, a commercially known cleaner. Two compositions were considered to behave substantially similarly if the amount of red soil removed was within about 10% at low and high concentrations and within about 15% at intermediate concentrations.

To determine whether the ionic liquids would be efficacious in removing red/food soils, the commercially-available ionic liquids were evaluated. The Colonial Chemical Metal Degreasing Formula shown in Table 2 was evaluated using formulations containing either the isostearyl ethylimidazolinium ethosulfate (Cola® Solv IES) or the oleyl ethylimidazolinium ethosulfate (Cola® Solv OES) ionic liquid. The concentrations of the formulations (25% ionic liquids) were diluted with water to test the efficacy of varying concentrations of actives in use dilutions, ranging between about 5% and about 20%. The control for the cleaning efficacy was water against the red soils. The results are shown graphically in FIG. 1. As shown, the ionic liquid compositions—the Colonial Chemical Metal Degreasing Formula—provided beneficial cleaning efficacy against red food soils.

Example 2

The efficacy of ionic liquid cleaning compositions according to the invention was further evaluated. The ability of compositions of the present invention and comparative compositions to remove red soil from a surface according to the methods of Example 1. The control (Super Excellent Standard (NPE 9.5) (18% actives)) was compared to formulations (18% actives) of the ionic liquids, each of which were then diluted to 4, 8 and 16 ounce per gallon dispensing rate concentrations. Each composition was a 1:1 replacement of NPE with an ionic liquid (isostearyl ethylimidazolinium ethosulfate or oleyl ethylimidazolinium ethosulfate). The formulas compared to the control are set forth in Table 3.

TABLE 3

| % Actives | Softened Water | Phosphoric acid (75%) | isopropanol (99%) | Cola ® Solv IES or Cola ® Solv OES | Tetrasodium EDTA (40%) |
|---|---|---|---|---|---|
| 18% | QS | 0.1-0.55% | 0-5% | Control (18% NPE) | 4-8% |
| 18% | QS | 0.1-0.55% | 0-5% | 18% | 4-8% |
| 13.5% (3/4) | QS | 0.1-0.55% | 0-5% | 13.5% | 4-8% |
| 9% (1/2) | QS | 0.1-0.55% | 0-5% | 9% | 4-8% |
| 4.5% (1/4) | QS | 0.1-0.55% | 0-5% | 4.5% | 4-8% |
| 2.25% (1/8) | QS | 0.1-0.55% | 0-5% | 2.25% | 4-8% |

Figure 2:
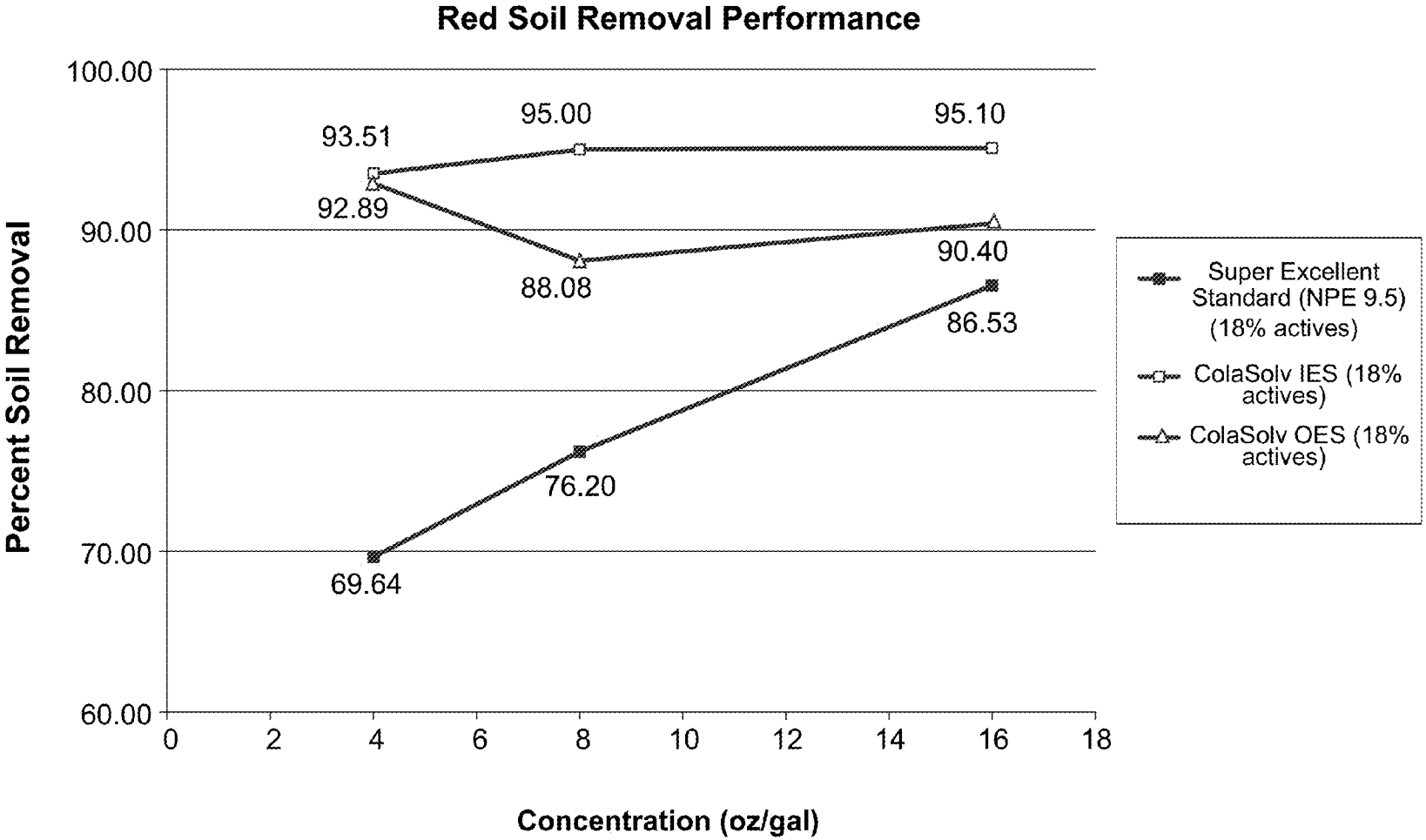
FIG. 2 is a graph showing representative examples of ionic liquid compositions having 18% actives in comparison to the control, Super Excellent (with NPE 9.5) (18% actives) on cleaning of red food soil.

The results are shown graphically in FIG. 2. As shown, the ionic liquid compositions according to the invention outperformed the conventional NPE hard surface cleaner.

Example 3

The efficacy demonstrated of equal comparisons (18% actives) of Example 2 lead to further evaluation of the efficacy of ionic liquid cleaning compositions according to the invention. The ability of compositions of the present invention and comparative compositions to remove red soil from a surface was again conducted in accordance with the methods of Example 1. The control (Super Excellent Standard (NPE 9.5) (18% actives)) was compared to formulations of the ionic liquids (13.5% actives) each diluted to 4, 8 and 16 ounce per gallon concentrations. As a result, the comparative compositions according to the invention are less than a 1:1 replacement of NPE with an ionic liquid (isostearyl ethylimidazolinium ethosulfate or oleyl ethylimidazolinium ethosulfate).

Figure 3:
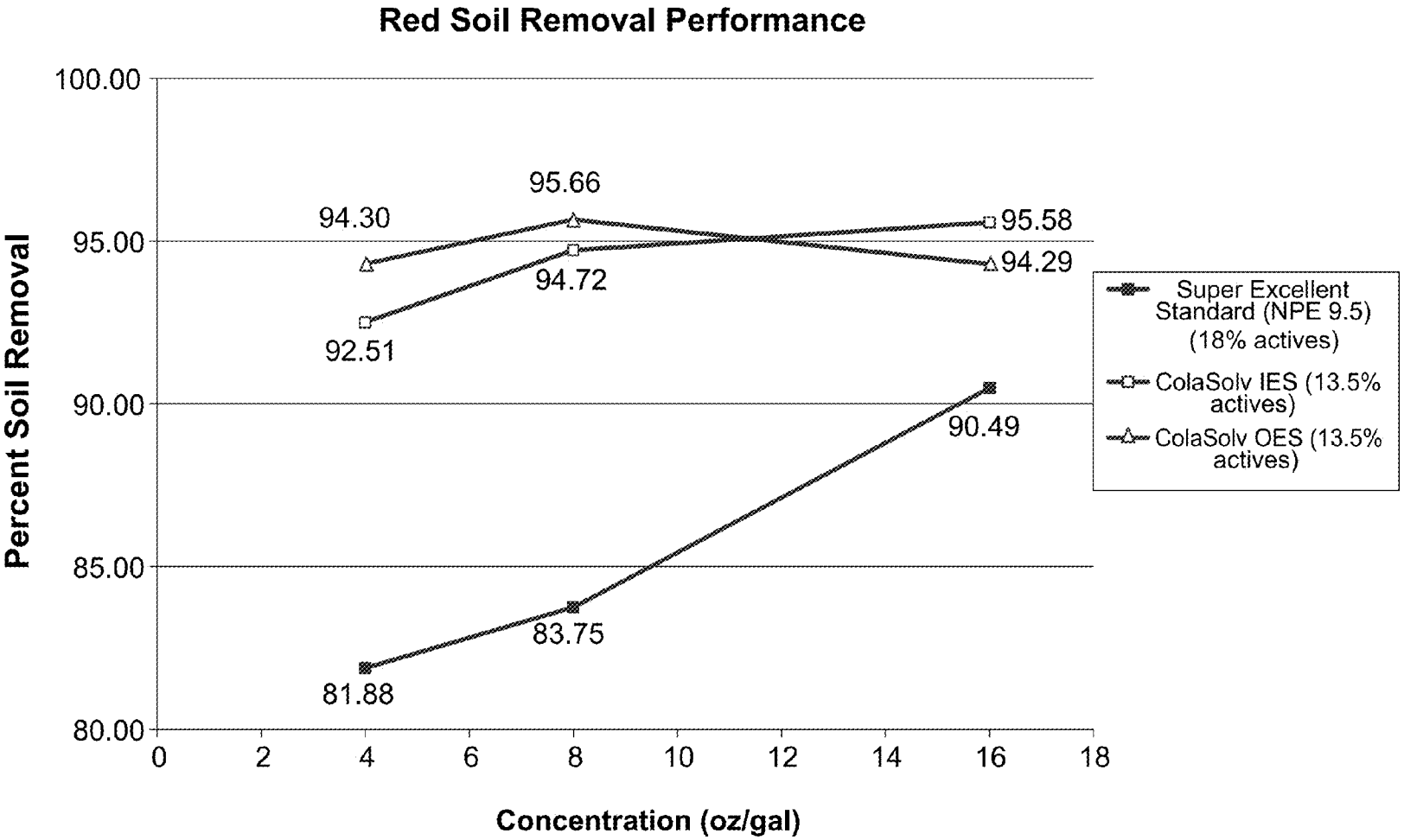
FIG. 3 is a graph showing representative examples of ionic liquid compositions having a reduced 13.5% actives in comparison to the control, Super Excellent (with NPE 9.5) (18% actives) on cleaning of red food soil.

The formulas compared to the control are set forth in Table 3. The results are shown graphically in FIG. 3. As shown, the ionic liquid compositions according to the invention outperformed the conventional NPE hard surface cleaner.

Example 4

The efficacy demonstrated in Examples 2 and 3 showing the outperformance of the ionic liquid compositions in comparison to the control (Super Excellent Standard (NPE 9.5) (18% actives)) lead to further evaluation of the efficacy of ionic liquid cleaning compositions at further decreased levels of actives according to the invention. Again, the ability of compositions of the present invention and comparative compositions to remove red soil from a surface was again conducted in accordance with the methods of Example 1. The control (Super Excellent Standard (NPE 9.5) (18% actives)) was compared to formulations of the ionic liquids (9%, 4.5% and 2.25% actives) each diluted to 4, 8 and 16 ounce per gallon concentrations. As a result, the comparative compositions according to the invention use half the actives as the NPE compositions by employing an ionic liquid (isostearyl ethylimidazolinium ethosulfate or oleyl ethylimidazolinium ethosulfate).

The formulas compared to the control are set forth in Table 3.

Figure 4:
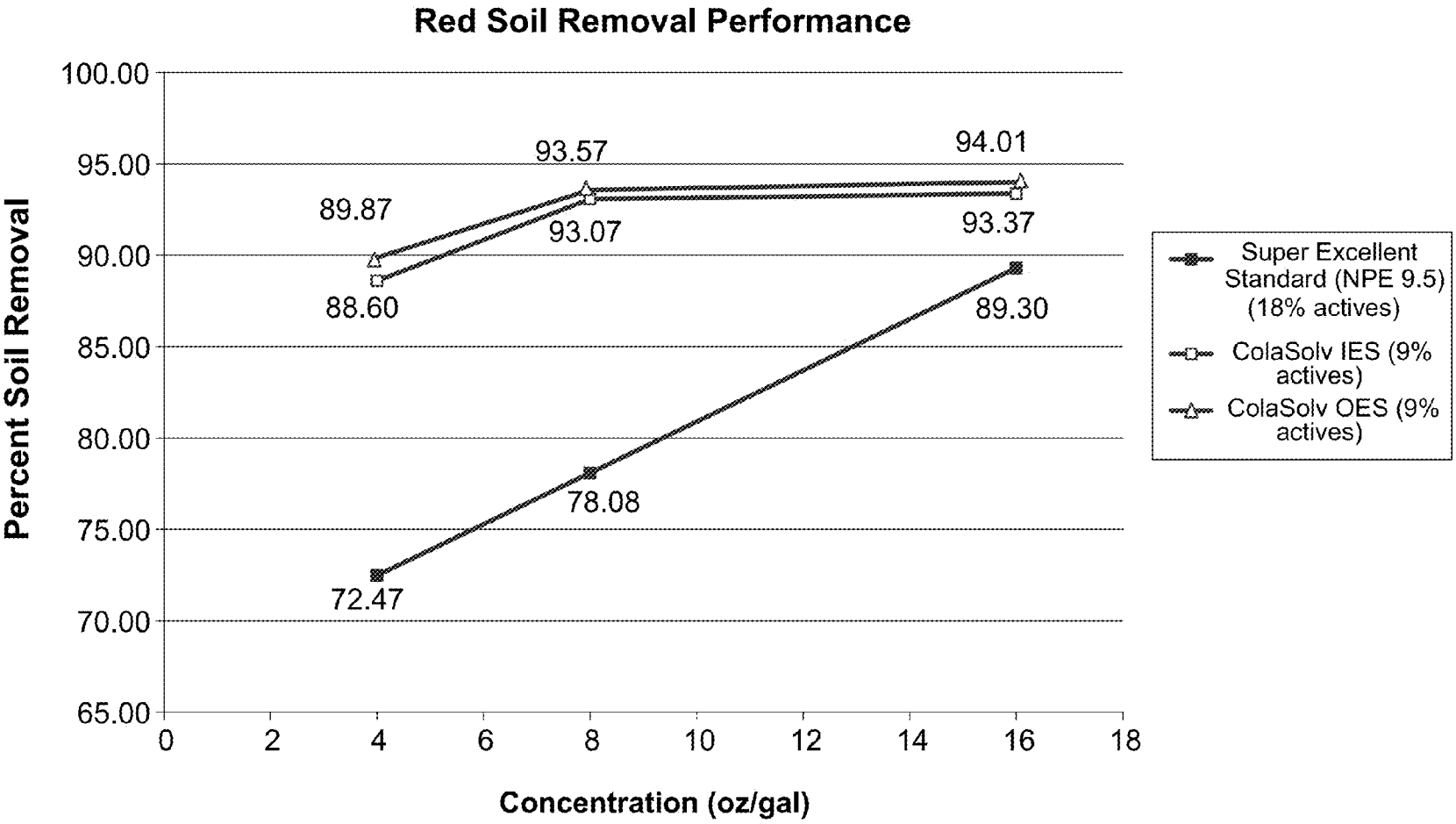
FIG. 4 is a graph showing representative examples of ionic liquid compositions having a reduced 9% actives in comparison to the control, Super Excellent (with NPE 9.5) (18% actives) on cleaning of red food soil.

The results of the comparison of Super Excellent Standard (NPE 9.5) (18% actives) and formulations of the ionic liquids (9% actives) each diluted to 4, 8 and 16 ounce per gallon concentrations are shown graphically in FIG. 4. As shown, the ionic liquid compositions according to the invention outperformed the conventional NPE hard surface cleaner despite having one-half the actives level in the composition.

Figure 5:
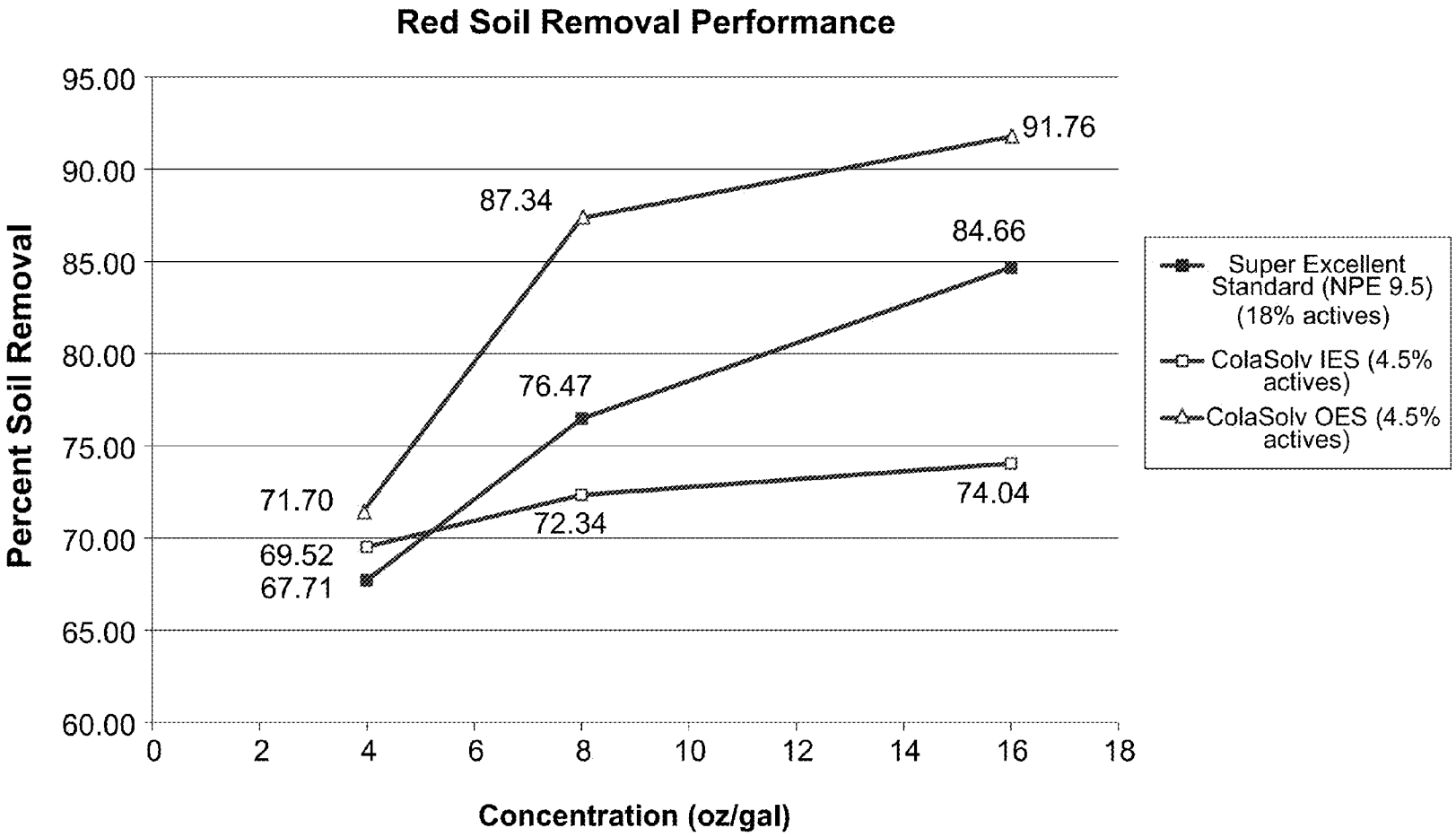
FIG. 5 is a graph showing representative examples of ionic liquid compositions having a reduced 4.5% actives in comparison to the control, Super Excellent (with NPE 9.5) (18% actives) on cleaning of red food soil.

The results of the comparison of Super Excellent Standard (NPE 9.5) (18% actives) and formulations of the ionic liquids (4.5% actives) each diluted to 4, 8 and 16 ounce per gallon concentrations are shown graphically in FIG. 5. As shown, the ionic liquid compositions according to the invention outperformed the conventional NPE hard surface cleaner at 4 oz./gallon dilutions. The Cola® Solv OES (4.5% actives) formulation also outperformed the conventional NPE hard surface cleaner at 8 oz./gallon and 16 oz./gallon dilutions.

Figure 6:
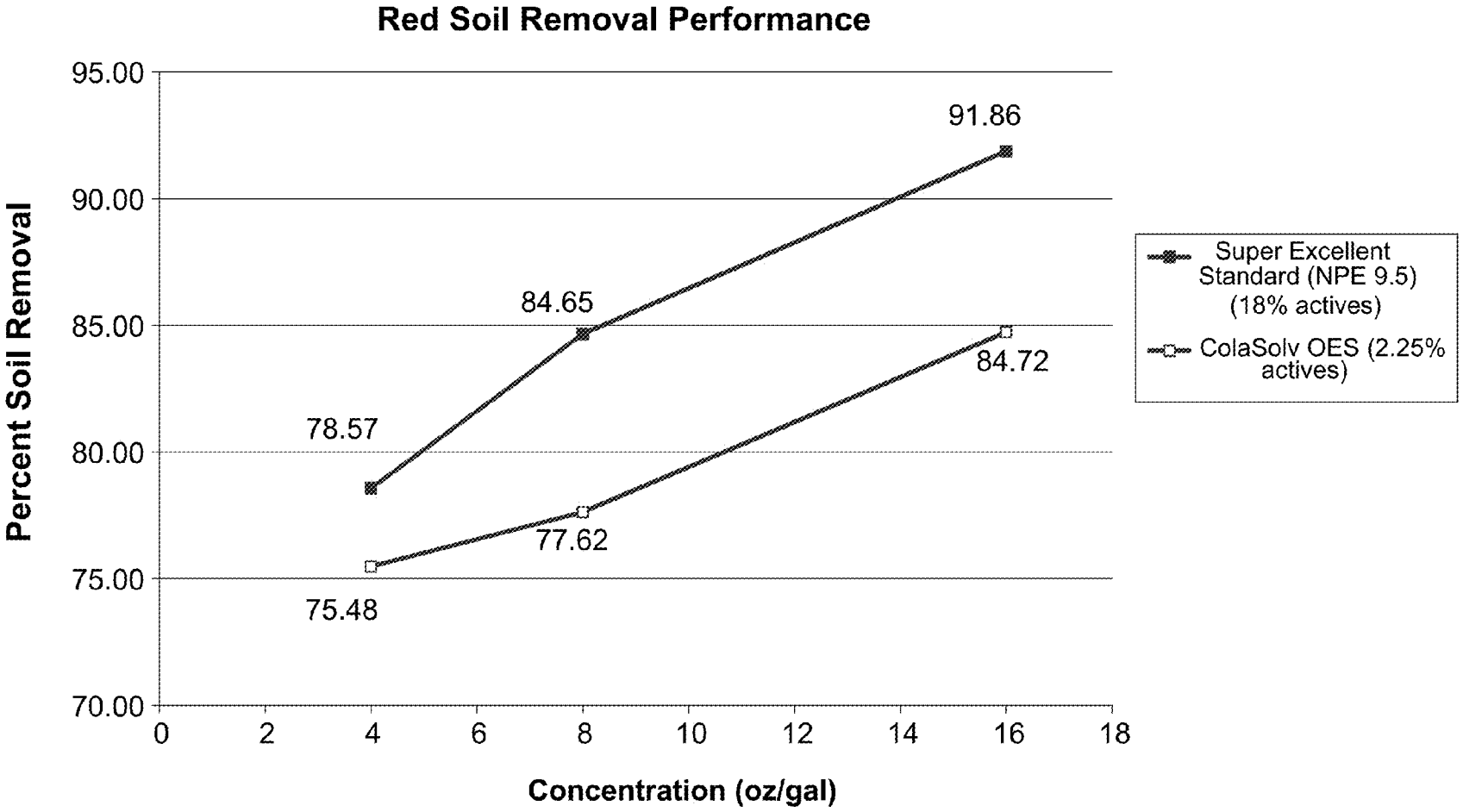
FIG. 6 is a graph showing a representative examples of a Cola®Solv OES ionic liquid composition having a reduced 2.25% actives in comparison to the control, Super Excellent (with NPE 9.5) (18% actives) on cleaning of red food soil.

The results of the comparison of Super Excellent Standard (NPE 9.5) (18% actives) and formulations of the Cola® Solv OES ionic liquid (2.25% actives) each diluted to 4, 8 and 16 ounce per gallon concentrations are shown graphically in FIG. 6. As shown, the ionic liquid compositions at the significantly reduced 2.25% actives, in comparison to the control of 18% actives, did not outperform the control for red soil removal performance.

Example 5

The efficacies of use of ionic liquids for red soil removal lead to the evaluation of comparative formulations including additional co-surfactants. The ability of compositions of the present invention and comparative compositions to remove red soil from a surface was again conducted in accordance with the methods of Example 1. The control (Super Excellent Standard (NPE 9.5) (18% actives)) was compared to formulations employing co-surfactants with the ionic liquids set forth in Table 2 to determine whether additional efficacy was achieved with formulations incorporating a co-surfactant.

Figure 7:
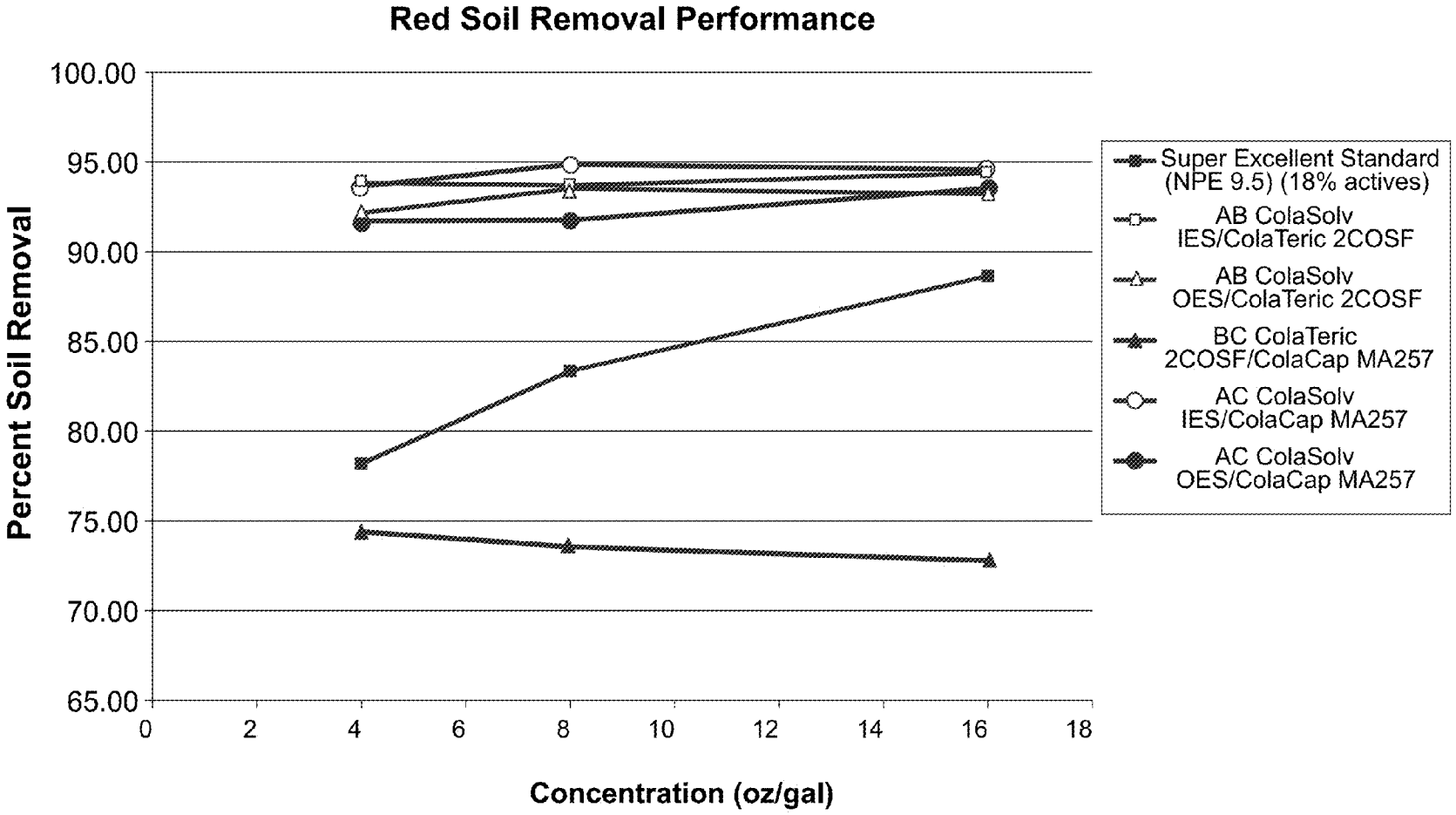
FIGS. 7 and 8 are graphs showing a examples of Cola®Solv IES and Cola®Solv OES ionic liquid compositions employing co-surfactants in comparison to the control, Super Excellent (with NPE 9.5) (18% actives) on cleaning of red food soil.
Figure 8:
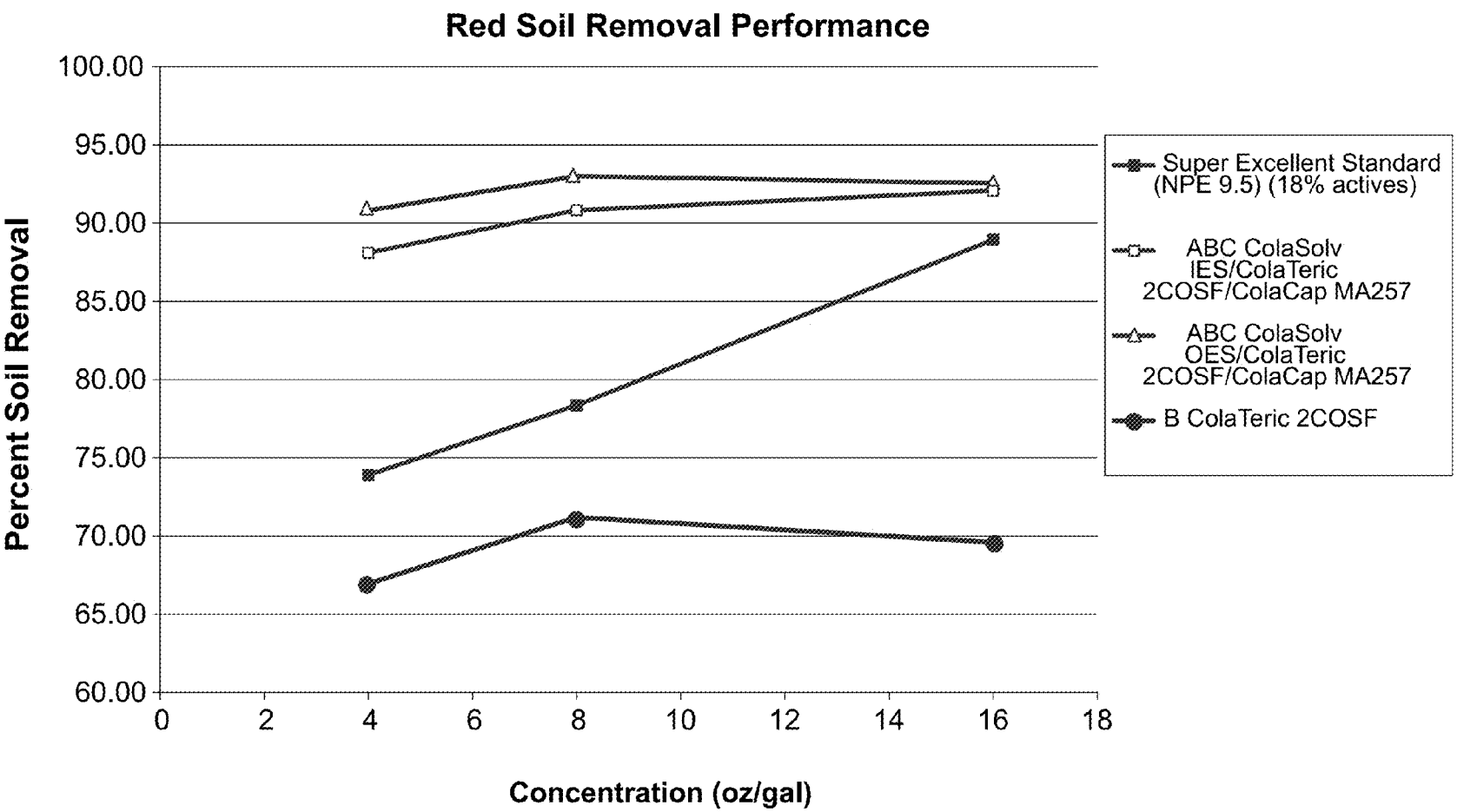

The results of the comparison of Super Excellent Standard (NPE 9.5) (18% actives) and various co-surfactant formulations of the ionic liquid each diluted to 4, 8 and 16 ounce per gallon concentrations are shown graphically in FIGS. 7 and 8. As shown, the ionic liquid compositions containing Cola® Solv OES and/or Cola® Solv IES all outperformed the control for soil removal performance.

Surprisingly, the co-surfactants tested in various formulations of the example are not required for soil removal performance according to the invention. As demonstrated in FIGS. 7 and 8, when the co-surfactants were tested alone and/or in combination with one another the performance (e.g. soil removal efficacy) did not improve over the control.

Example 6

Solvent test method was also evaluated using the Cola® Solv IES ionic liquid to determine soil removal performance on difficult soils, including lipstick, permanent marker, ink, pencil and crayon. The Colonial Metal Degreasing Formula with the Cola®Solv IES ionic liquid composition of Table 2 was adjusted to formulate a 5%, 10% and 20% actives formulation for evaluation.

Solvent Test Methods. All black 3"×3" vinyl composite tiles were painted with white paint and allowed to dry for 1 week (All Surface Enamel Acrylic Latex High Gloss White: 6403-25882 from Sherwin Williams). Soils including color crayon, pen, lipstick, pencil, and permanent marker were applied to tiles using the soiling agent (e.g. crayon, pen, etc.) and were allowed to dry at room temperature for 1 day. The next day, the tiles were placed into a tray and 10 grams of the test cleaning composition was applied to (e.g. saturated into) a cheese cloth. The soil removal test was conducted using a Precision Force Applicator (PFA), available from Precision Analytical Instruments, Inc. using the saturated cheese cloth. The tiles were then placed into the PFA. The tiles were then scrubbed with about 1 pound of pressure with the moistened cheese cloth for 64 cycles. The cheese cloth was changed after every 16 cycles.

The experimental results demonstrated the Cola®Solv IES ionic liquid formulation performed well on waxy-type soils (e.g. lipstick, crayon), and also performed well on pencil. The Cola®Solv IES ionic liquid formulation did not perform well on permanent marker and pen stains.

Various modifications and additions can be made to the exemplary embodiments discussed without departing from the scope of the present invention. For example, while the embodiments described above refer to particular features, the scope of this invention also includes embodiments having different combinations of features and embodiments that do not include all of the above described features.

What is claimed is:

1. A concentrated cleaning composition comprising:

(a) an ionic liquid constituting between about 1% and about 50% by weight of the cleaning composition, wherein said ionic liquid is isostearyl ethylimidazolinium ethosulfate, oleyl ethylimidazolinium ethosulfate or a combination thereof;

(b) from about 4 wt-% and about 8 wt-% of a chelant and/or sequestrant water conditioning agent;

(c) from about 0.1 wt-% and about 0.55 wt-% of an acid source; and (d) from about 30 wt-% to about 90 wt-% of water, wherein the cleaning composition comprises less than about 0.5% by weight alkyl phenol ethoxylates and employs a percentage actives of less than about 18%.

2. The cleaning composition of claim 1, wherein the cleaning composition employs a percentage actives of less than about 10% and comprises less than about 0.1% by weight alkyl phenol ethoxylates.

3. The cleaning composition of claim 1, wherein the water conditioning agent constitutes between about 5% and about 7% by weight of the cleaning composition.

4. The cleaning composition of claim 1, wherein the water constitutes between about 40% and about 90% by weight of the cleaning composition.

5. The cleaning composition of claim 1, further comprising a solvent constituting between about 0.1% and about 5% by weight of the cleaning composition.

6. The cleaning composition of claim 1, wherein the water conditioning agent is ethylenediaminetetraacetic acid tetrasodium salt.

7. The cleaning composition of claim 1, wherein the cleaning composition has a pH of between about 6.5 and about 10.

8. A concentrated hard surface cleaner comprising:

(a) from about 1 wt-% to about 30 wt-% of an ionic liquid, wherein the ionic liquid is isostearyl ethylimidazolinium ethosulfate, oleyl ethylimidazolinium ethosulfate or a combination thereof;

(b) from about 5 wt-% and about 7 wt-% of a chelant and/or sequestrant water conditioning agent;

(c) from about 0.3 wt-% and about 0.5 wt-% of an acid source; and (d) from about 40 wt-% to about 90 wt-% of water, wherein the cleaning composition is substantially free of alkyl phenol ethoxylates and employs a percentage actives of less than about 18%.

9. The hard surface cleaner of claim 8, wherein the ionic liquid constitutes between about 2% and about 30% by weight of the hard surface cleaner.

10. The hard surface cleaner of claim 9, wherein the ionic liquid is an oleyl ethylimidazolinium ethosulfate or isostearyl ethylimidazolinium ethosulfate which constitutes between about 2% and about 30% by weight of the hard surface cleaner, and wherein the composition does not employ a co-surfactant.

11. A method of removing soils from a surface, the method comprising:

(a) diluting a concentrated cleaning composition with water of dilution to form a use solution, wherein the cleaning composition comprises an ionic liquid constituting between about 1% and 50% by weight of the cleaning composition, wherein said ionic liquid is isostearyl ethylimidazolinium ethosulfate, oleyl ethylimidazolinium ethosulfate or a combination thereof; from about 4 wt-% and about 8 wt-% of a chelant and/or sequestrant water conditioning agent, from about 0.1 wt-% and about 0.55 wt-% of an acid source, and from about 30 wt-% to about 90 wt-% of water, wherein the cleaning composition comprises less than about 0.5% by weight alkyl phenol ethoxylates; and (b) contacting the surface with the use solution, wherein the cleaning composition employs a percentage actives of less than about 18% while providing substantially similar cleaning performance to an alkyl phenol ethoxylate-containing cleaning composition.

12. The method of claim 11, wherein diluting the cleaning composition with water of dilution comprises diluting at weight ratio of cleaning composition to water of dilution of up to about 1:256.

13. The method of claim 12, wherein the ionic liquid is oleyl ethylimidazolinium ethosulfate or isostearyl ethylimidazolinium ethosulfate and wherein the composition does not include a co-surfactant.

14. The method of claim 11, wherein the cleaning composition is low VOC, bio-based and substantially free of alkyl phenol ethoxylates.

15. The method of claim 11, wherein the cleaning composition has a pH of between about 6.5 and about 10.

16. The method of claim 11, wherein the cleaning composition employs a percentage actives of less than about 10%.

* * * * *